United States Patent [19]

Maxwell et al.

[11] Patent Number: 4,851,246

[45] Date of Patent: Jul. 25, 1989

[54] DUAL COMPARTMENT FOOD PACKAGE

[75] Inventors: Holly A. Maxwell, Minneapolis; Robert L. Esse, Monticello, both of Minn.

[73] Assignee: General Mills, Inc., Minneapolis, Minn.

[21] Appl. No.: 70,270

[22] Filed: Jul. 6, 1987

[51] Int. Cl.[4] ..... B65D 81/32; B65D 81/34

[52] U.S. Cl. ..... 426/107; 206/219; 206/221; 219/10.55 E; 383/103; 426/111; 426/113; 426/118; 426/120

[58] Field of Search ..... 426/107, 113, 118, 111, 426/120, 234, 243; 383/100, 107, 103, 38, 40; 206/219, 221; 219/10.55 E

[56] References Cited

U.S. PATENT DOCUMENTS

| | | | |
|---|---|---|---|
| 2,566,122 | 8/1951 | Denison | 206/221 |
| 2,916,197 | 12/1959 | Detrie et al. | 206/219 |
| 3,023,947 | 3/1962 | MacDuffie | 383/107 |
| 3,082,867 | 3/1963 | Gelpey | 383/38 |
| 3,149,943 | 9/1964 | Amador | 383/38 |
| 3,156,352 | 11/1964 | Hayhurst | 206/219 |
| 3,272,324 | 9/1966 | Schneider et al. | 206/221 |
| 3,293,048 | 12/1966 | Kitterman | 206/219 |
| 3,302,632 | 2/1967 | Fichtner | 219/10.55 E |
| 3,462,070 | 8/1969 | Corella | 206/219 |
| 3,809,224 | 5/1974 | Greenwood | 383/38 |
| 3,835,280 | 9/1974 | Gades et al. | 219/10.55 E |
| 3,937,396 | 2/1976 | Schneider | 383/100 |
| 4,013,798 | 3/1977 | Goltsos | 219/10.55 E |
| 4,051,266 | 9/1977 | Goltsos | 426/120 |
| 4,081,646 | 3/1978 | Goltsos | 219/10.55 E |
| 4,132,811 | 1/1979 | Standing et al. | 219/10.55 E |
| 4,137,333 | 1/1979 | Daswick | 426/113 |
| 4,141,487 | 2/1979 | Faust | 383/103 |
| 4,219,573 | 8/1980 | Borek | 219/10.55 E |
| 4,233,325 | 11/1980 | Slangan et al. | 206/219 |
| 4,458,811 | 7/1984 | Wilkinson | 383/38 |
| 4,553,010 | 11/1985 | Bohrer | 219/10.55 E |
| 4,571,337 | 2/1986 | Cage et al. | 383/100 |
| 4,596,713 | 6/1986 | Burdette | 206/219 |
| 4,734,288 | 3/1988 | Engstrom et al. | 383/100 |
| 4,735,513 | 4/1988 | Watkins et al. | 219/10.55 E |

FOREIGN PATENT DOCUMENTS

| | | | |
|---|---|---|---|
| 60-2155 | 1/1985 | Japan | 426/113 |
| 60-24168 | 2/1985 | Japan | 426/113 |
| 64945 | 6/1942 | Norway | 206/219 |
| 1110776 | 4/1968 | United Kingdom | 426/120 |

*Primary Examiner*—Steven Weinstein

*Attorney, Agent, or Firm*—L. McRoy Lillehaugen; John A. O'Toole; Stuart R. Peterson

[57] ABSTRACT

A package for use in a microwave oven is sealed at both of its ends. The package is transversely folded intermediate its ends to form a first compartment in which one food product is contained, such as kernels of corn to be popped, and a second compartment in which is contained a second food product, such as a flavoring component or additive. The fold in one face wall extends inwardly and the fold in the other face wall extends outwardly, the two folds being nested together. The sides of the package are pleated. Whereas the transverse sections forming the folds are secured together in one instance and secured to the other in another instance, the pleats of the other face wall are secured to the fold in the one face wall by adhesive spots. A sufficient build-up of pressure in the compartment containing the kernels to be popped will cause the folded configuration to at least partially unfold, thereby providing communication between the compartment in which the kernels are contained and the compartment in which the flavoring component or additive is contained. The configuration of the fold is such that a dam remains which prevents any undesired flow of additive from the compartment in which it is contained into the compartment in which the corn kernels are initially contained. By grasping the closed end adjacent the second compartment and allowing the package to assume a vertical condition, the user can shake the package, simply moving the closed end up and down so that the additive in the second compartment gravitationally flows downwardly into the first compartment where it is dispersed throughout the popped product.

22 Claims, 4 Drawing Sheets

FIG. 9
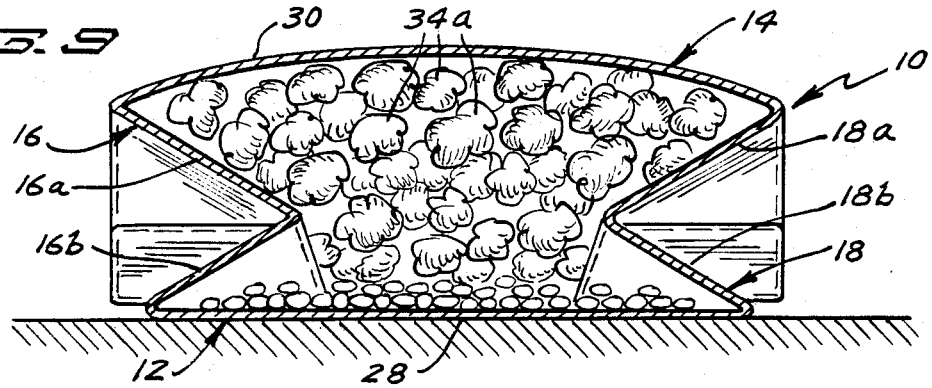
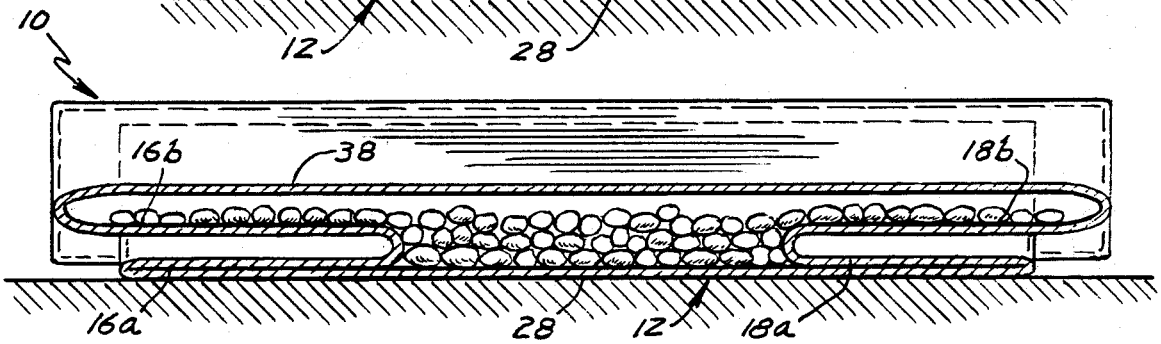
FIG. 10
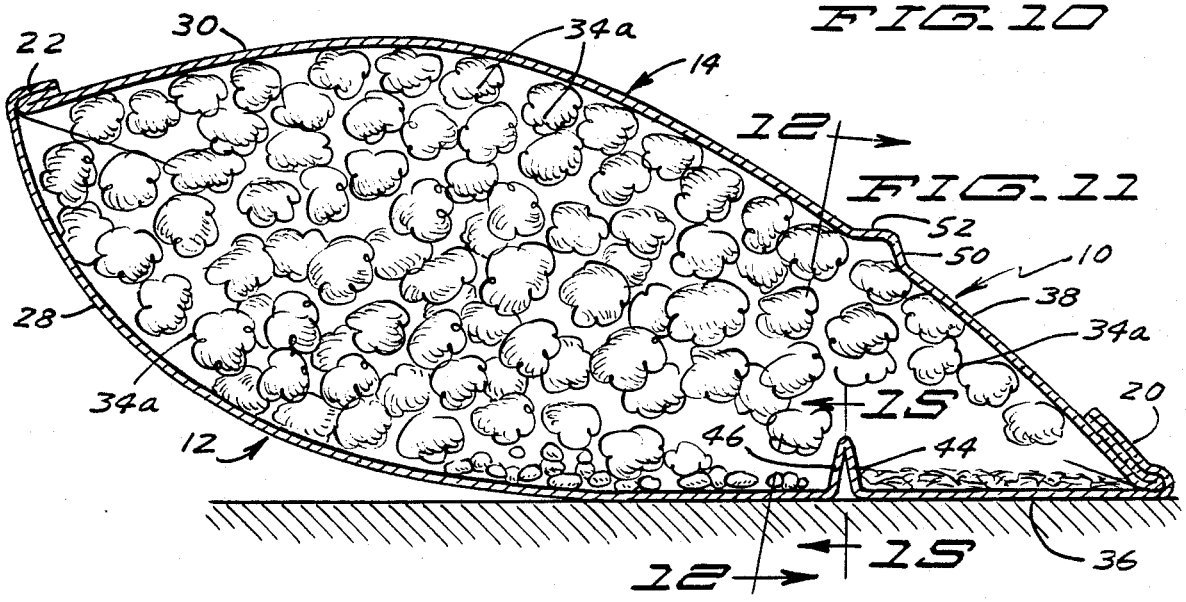
FIG. 11
FIG. 12
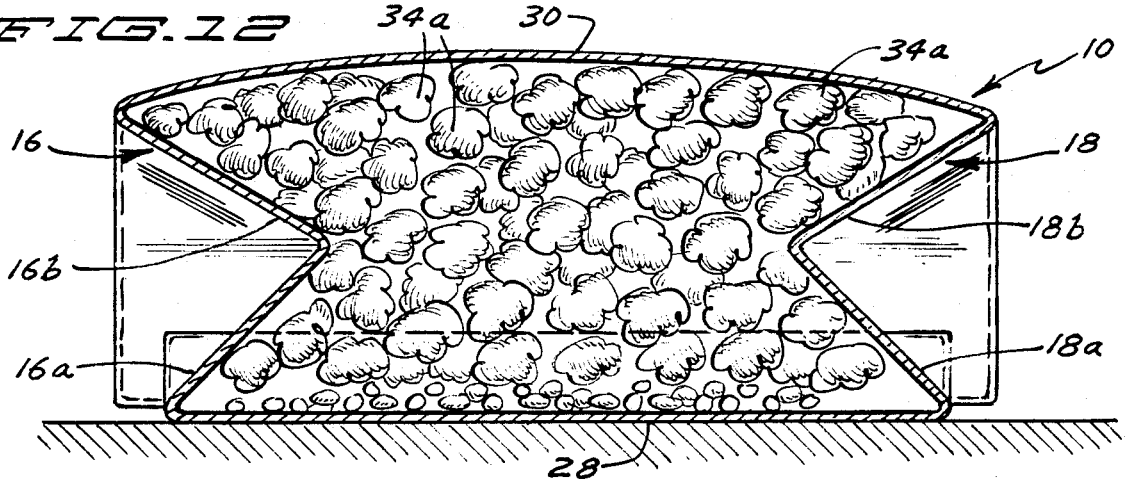

10
14
16
16a
18
18a
18b
20
20a
20b
20c
22
24
30
38
42
44
46
49
50
52
82
84
86
88
90
34a

DUAL COMPARTMENT FOOD PACKAGE

BACKGROUND OF THE INVENTION

1. Field of the Invention

This invention relates generally to a package containing two different food products and a method for heating same in a microwave oven, and pertains more particularly to such a package having two compartments, popcorn kernels being contained in one compartment and an additive material in the other.

2. Description of the Prior Art

The great majority of packages for microwave popping in one's home are fabricated with only a single chamber in which both the unpopped corn and liquified fat are contained. Most of these packages provide an acceptable popped product. However, where a flavor component is to be added to the popped corn, this is usually left up to the consumer. If the consumer wishes to add a flavor, the consumer must prepare such an additive separately, then adding it to the popped corn after first removing the popped corn from the package. This can be messy and a nuisance, so users who would otherwise like a flavoring material added to their popped corn simply do not bother with the extra work involved in achieving a flavored popcor product.

One attempt to add a flavor to the corn during the period in which it is being popped in its package, however, is described in Darrell C. Burdette U.S. Pat. No. 4,596,713, issued on June 24, 1986 titled "Microwave Food Packets Capable of Dispersing a Food Additive During Heating." Several embodiments are disclosed in which an additive or flavoring is contained in a separate packet within the larger package in which the corn kernels are contained. When the packet reaches a sufficiently elevated temperature, the plastic film constituting the packet softens sufficiently to permit opening thereof, thereby releasing the additive onto the popped corn. Inasmuch as the packet is contained completely within the confines of the package, the release of the additive onto the popped corn is determined almost exclusively by temperature, although to some extent by whatever pressure is developed within the packet. Being in the same chamber with the corn to be popped, the packet and its contents are for all intents and purposes subjected to the same elevated temperature needed for effective popping. Certain additives, however, such as cheese coatings, should not be heated to such an extent, for they become unstable, scorch, lose their taste and otherwise deteriorate when overheated. The employment of a heater patch, which enhances the popping of popcorn, would only aggravate the situation, for a composition containing cheese would be even more likely to burn.

While not concerned with the popping of corn, attention is also directed to Charles N. Standing U.S. Pat. No. 4,132,811, granted on Jan. 2, 1979, et al. for "Food Package for Assuring Uniform Distribution of Microwave Energy and Process for Heating Food." One embodiment disclosed in this patent involves a transverse seal for forming two compartments, one compartment containing a food product, such as cookies, cakes or biscuits, and the other containing a small amount of water so that the resulting vapor produced by the microwave heating of the water is instrumental in both moving the product and supplying moisture thereto via the seal when broken (or through a vent when provided).

SUMMARY OF THE INVENTION

A general object of the invention is to provide a package with a transverse portion forming two compartments, one compartment containing one food product and the other compartment a different food product with the two products initially being kept separated. It is planned that the two products be differentially heated, so with this in mind a layer of microwave coupling material or heater patch is employed in conjunction with the compartment containing the food product requiring the higher heating temperature.

A more specific object of our invention is to provide a popcorn package that will enable the user to add a supplement, such as a particular flavor, to the corn after it has been popped in a microwave oven, doing so with but little extra effort. In this regard, an aim of the invention is to permit the dispersal of the additive over the popped corn in a highly convenient manner, a method that does not require any independent preparation of an additive by the consumer which must then be added to the popped corn after it has first been removed from the package. This can be a decided nuisance, especially if one is viewing a television program. Besides, such a chore can be messy, requiring a certain amount of cleaning up.

Another object is to provide a package in which kernels of corn to be popped are contained in one compartment that is heated to a much higher temperature and the additive in a second compartment separated from the first compartment and kept at a much lower temperature. In this way, when the additive must be maintained in a stable condition until used its quality can be better preserved so that a more tasteful popped product can be realized when the package is ultimately used. In other words, the shelf life of the additive, especially when in the form of a cheese sauce, may be increased by keeping it separate from the corn kernels. Likewise, the kernels can be better popped with a correspondingly higher popping rate being achieved by providing a wide temperature differential between the compartments.

Although the object set forth immediately above is concerned with the initial preservation of quality as far as an additive is concerned, it is also an object of the invention to maintain the quality of the additive during the actual microwave heating of the corn kernels, keeping the additive away from the heater patch to prevent scorching of the additive. In this regard, it is within the purview of the invention to prevent the mixing of the additive with the popped corn until the popping cycle has been completed. To achieve this, what amounts to a transverse dam is provided within the package that remains throughout the heating cycle. The actual mixing of the additive with the popped corn is accomplished when the user shakes the package after the popping has been completed.

Another object of our invention is to provide a package in which the popping of the popcorn kernels is enhanced by initially confining the charge of kernels to a more limited space having a heater patch associated therewith. Provision is made for the compartment containing the kernels to expand, gussetted sidewalls permitting such expansion. However, the size of the compartment with the kernels in it increases still more when communication between the two compartments is automatically established toward the end of the popping period. In this way, the continued popping of the kernels will allow the popped corn to enter the compartment in which the additive is contained, thereby causing the compartment with the additive to expand and thereby provide an even greater space within the package for the accommodation of the popped corn. A dam, however, prevents the additive or flavor component from at this time entering the compartment being subjected to the high temperature developed by the heater patch.

Yet another object of the invention is to make use of a dual compartment popcorn package in which an opening between the two compartments is automatically established during the microwave popping period. The communication between compartments is of a pressure-responsive nature rather than a heat-responsive type as in U.S. Pat. No. 4,596,713, supra. Hence, an aim of the invention is to establish communication between two laterally spaced compartments at a more precise time, relying primarily on a pressure build-up rather than principally depending upon a thermal build-up. Thus, an aim of the invention is to effect the communication between the corn and flavor compartments by pressure and not by temperature, thereby more accurately controlling when the communication takes place.

Still another object is to provide dual compartment package for containing both kernels of corn to be popped and an additive or flavor which package can be fabricated from conventional paper materials that have been extensively used heretofore and which are relatively inexpensive.

Also, the invention has for an object a relatively simple package that can be provided at a relatively low cost, especially inasmuch as it does not require expensive materials or any appreciable increase in the amount of paper stock. It is also more economical to have the bag stock of the sam material throughout rather than having the package fabricated from composite materials. Therefore, an aim of the invention is to make use of the same laminated paper stock throughout the entire package.

Still further, an object of the invention is to provide an easy way in which the user mixes the additive with the popped corn. In this regard, an aim of the invention is to allow the user to pick up the package after the corn therein has been popped, then grasping the end thereof adjacent the compartment where the additive is contained and holding that end of the package uppermost. Shaking of the package will then cause the additive to gravitationally flow downwardly and be dispersed over the popped corn therebelow. In this way, the additive is uniformly mixed with the popped product. This is especially important when the additive constitutes a cheese coating or other material that deteriorates when exposed to severe heat.

Another object is to provide a package that automatically vents itself when sufficiently heated and expanded.

Briefly, our invention envisages a laminated paper package derived from a tubular bag stock having its opposite ends sealed and having an intermediate portion reversely folded so as to form two separate compartments. The popcorn kernels are contained in one compartment and an additive, such as a cheese coating, in the second compartment. Whereas the paper stock constitutes conventional laminated kraft paper and glassine paper or a similar material, provision is made for sandwiching a heater patch between the layers of kraft paper and glassine paper, the heater patch, as an example, being in the form of a metalized film which converts some of the microwave energy to heat energy and thus increases the temperature in the compartment containing the corn kernels therein.

Inasmuch as there is deliberately provided an initial lack of communication between the compartment containing the corn kernels and the laterally separated compartment containing the additive, the compartment having the additive therein is maintained at a lower temperature than that of the kernel-containing compartment. In this way, the quality of the additive, particularly when of a heat sensitive nature, is preserved until the very moment that the popping of the kernels has been completed.

Communication between the two laterally separated compartments is automatically derived from vapor pressure that is generated by the microwave heating of the kernels within the first compartment. However, when the pressure has built up to an appropriate extent, the folded region unfolds sufficiently so that communication is established between the two compartments. Concomitantly, the package is automatically vented as the unfolding progresses. To some degree a flow of popped corn into the compartment in which the additive is located takes place. The fold is configured so that, even though communication is established, there remains a transverse dam that prevents any premature mixing of the additive with most of the popped corn so that deterioration of the flavor of the additive is prevented up until virtually the moment that the popped corn is to be removed from the package in which it has been heated.

When the popping of the corn has been completed, the user only has to grasp the closed end of the package that resides adjacent the compartment in which the additive has been contained, and then with the other end lowermost the user simply shakes the package to effect a good dispersal of the additive downwardly onto the popped product.

BRIEF DESCRIPTION OF THE DRAWINGS

FIG. 1 is a perspective view of a dual compartment package exemplifying our invention, the view depicting the package in the compact form in which it is marketed with other such packages;

FIG. 9 is an enlarged view taken in the direction of line 9—9 so as to illustrate how the gussets or pleats diverge to permit expansion of the compartment containing the corn kernels therein;

FIG. 10 is a transverse sectional view taken in the direction of line 10—10 of FIG. 8, the view being on a somewhat larger scale than FIG. 9 in order to show more clearly the gussets or pleats;

FIG. 11 is a longitudinal sectional view corresponding to FIG. 3, but on a somewhat smaller scale, and depicting the package at the completion of the popping period;

FIG. 12 is a sectional view taken in the direction of line 12—12 of FIG. 11;

FIG. 13 is a perspective view showing the package being shaken, a portion of the package having been removed in order to show how the additive is dispersed onto the fully popped corn;

FIG. 14 is a perspective view depicting the manner in which the user opens one end of the package in order to gain access to the popped contents; and FIG. 15 is a detail view taken in the direction of line 15—15 of FIG. 11, the view showing to better advantage a plurality of vent holes that automatically open during the popping cycle.

DESCRIPTION OF THE PREFERRED EMBODIMENT

Figures 2, 3, 4, 7:
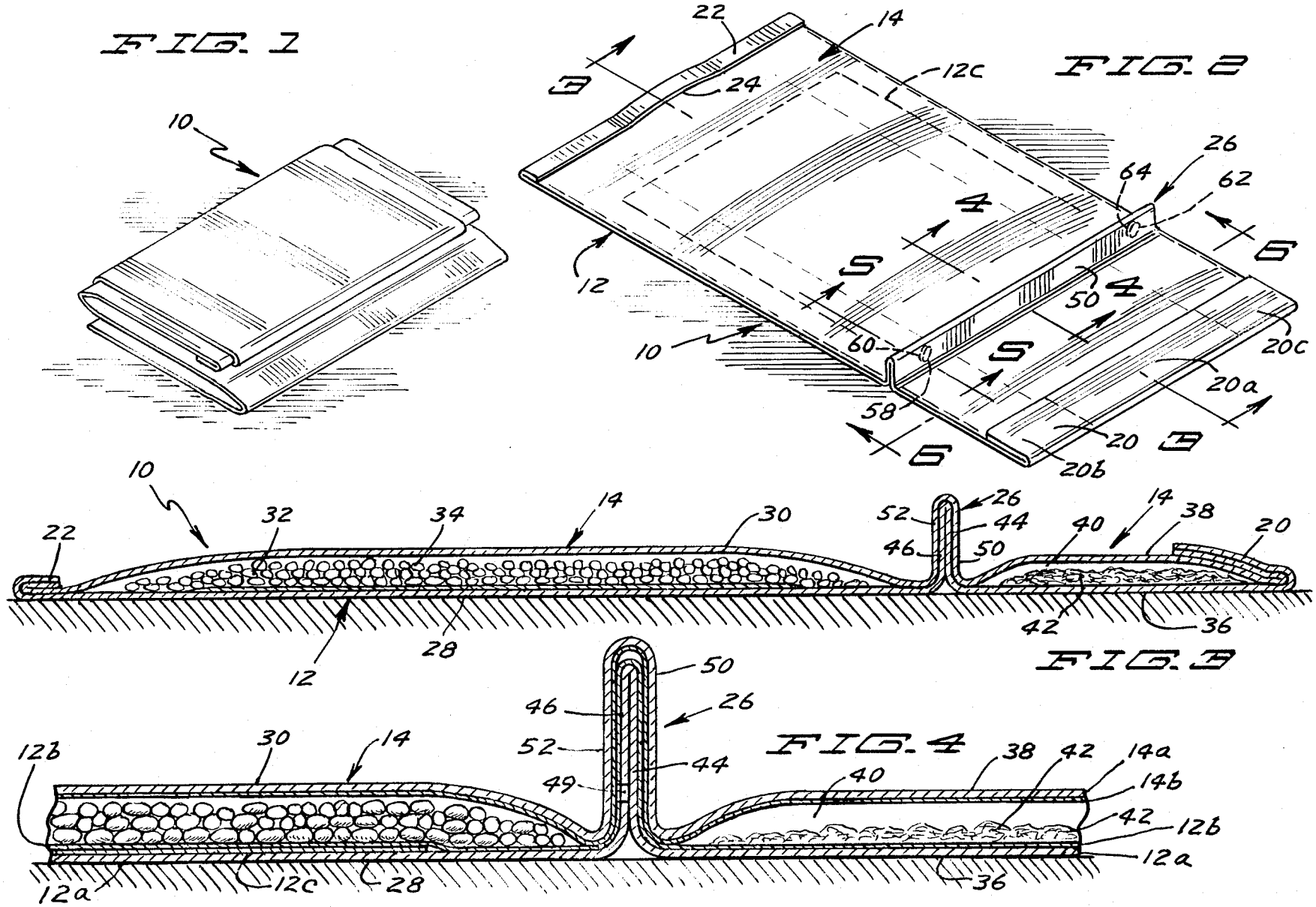
FIG. 2 is a perspective view taken in the same direction as FIG. 1 but with the package unfolded.
FIG. 3 is an enlarged sectional view taken in the direction of line 3—3 of FIG. 2.
FIG. 4 is a fragmentary sectional view taken in the direction of line 4—4 of FIG. 2, the view being on an even larger scale than FIG. 3 in order to illustrate the package's laminated construction.
FIG. 7 is a perspective view of a microwave oven with the fragmentarily depicted door thereof open so as to expose to view the package that has been placed therein in readiness for being heated by microwave energy.

Referring first to FIG. 1, the package exemplifying our invention has been denoted generally by the reference numeral 10. The package 10, as far as FIG. 1 is concerned, has been folded into a compact condition, a condition suitable for shipping with other such packages. At the outset, it can be stated that the package 10 is derived from laminated tubular bag stock composed of kraft paper lined with glassine paper or equivalent, as will become clearer when considering FIGS. 4 and 5. Tubular bag stock used when practicing our invention is conventional, so no need is seen to exist for depicting the sealed overlap that extends longitudinally along the tubular stock. Actually, the tubular bag stock from which the package 10 is fabricated is initially of indeterminate length, the individual package 10 being cut transversely from the tubular bag stock so as to possess an appropriate length for containing a charge of kernels to be popped and also an appropriate amount of additive, such as a cheese coating, to be dispersed onto the popped corn.

Even though the tubular bag stock is laminated, it will facilitate matters, at least at the moment, to refer to the lower face wall, as seen in FIG. 3, by just the reference numeral 12. Similarly, there is an upper face wall 14. Integral with the lower and upper face walls 12 and 14 are sidewalls 16 and 18 composed of pleats or gussets so as to permit expansion of the package 10 when subjected to microwave energy. In this regard, it will be observed that the sidewall 16 is comprised of pleats 16*a* and 16*b*, whereas the sidewall 18 is composed of pleats 18*a* and 18*b*. As can be understood from FIGS. 2 and 3, the package 10 is sealed at its opposite ends by folding over the walls 12 and 14 so as to form an end fold labeled 20 at one end and a somewhat similar end fold 22 at the other end of the package. The folds 20 and 22 are maintained in their folded condition by means of a suitable adhesive. However, only the central portion 20*a* of the fold 20 is adhered, there being unadhered end portions 20*b* and 20*c* that provide corner tabs, either of which can be later grasped to facilitate the opening of the package after the popping period has been completed (see FIGS. 2 and 14). Close inspection of FIG. 2, however, will indicate that there is a central portion labeled 24 that is unadhered so as to additionally facilitate opening of the package 10 after the popping cycle has been completed; the unadhered central portion 24 may function as a vent if the vapor pressure builds up sufficiently during the later-described popping cycle.

Playing an important role in the practicing of our invention is an intermediate fold at 26 which extends transversely across the entire package 10. What the fold 26 does is to provide lower and upper panels 28 and 30, respectively, that form a first compartment 32 that contains therein a charge 34 of kernels of popcorn. Somewhat similarly, although smaller, are formed panels 36 and 38 that provide a second compartment 40. Whereas the first compartment 32 contains the popcorn 34 to be popped, the second compartment 40 contains a flavoring composition or additive 42 comprised of, say, a material intended to impart a cheese flavor to the popped corn and perhaps a prescribed amount of flavored oil, the oil assisting in keeping the cheese composition 42 (or other ingredient) even cooler than it otherwise would be kept. What should be appreciated at this stage is that the kernels 34 and the additive 42 are kept completely separated by virtue of the fold 2 and that the two compartments 32, 40 have wide temperature differentials therebetween.

Describing the fold 26 in greater detail, it will be discerned that the lower wall 12 is inwardly folded so as to form transverse strip sections 44 and 46. These strip sections 44 and 46 confront each other. By means of an adhesive 45, which is greatly enlarged and horizontally hatched in FIG. 5, the strip sections 44 and 46 are retained in their confronting or engaged relationship. A plurality of laterally spaced vent holes 49 (see FIGS. 4 and 15) remain closed as long as the strip section 46 confronts the strip section 44; when the pressure loosens the adhesive, however, the holes 49 open to reduce the vapor pressure in the package 10 that has built up during the popping cycles. As will become apparent hereinafter, the vent holes 49 should be quite small.

Whereas the strip sections 44 and 46 are folded inwardly, strip sections 50 and 52 belonging to the upper wall 14 are folded outwardly. In other words, the strip sections 44 and 46 are literally nested within the strip sections 50 and 52. The strip section 50 is adhesively secured to the strip section 44 and the strip section 52 secured to the strip section 46.

The fold 26 should be maintained as a fold up to the time that the package 10 is sold and even thereafter until an appropriate moment has been reached during the popping cycle. Cooperating in the retention of the fold 26 as a fold is a plurality of adhesive spots or tacks on the order of one-eighth inch in diameter. These adhesive spots have been labeled 58, 60, 62 and 64 and are located so as to releasably secure the pleat 18*a* to the strip section 50 and the pleats 16*a* to the strip section 52. It will be observed that the directional line 5—5 is taken through the adhesive spots 58 and 60, a region involving the pleats 16*a*, 16*b*18*a*18*b* and therefore devoid of any kernels 34. Therefore, to help in understanding the retention feature performed by the spots 58 and 60, these spots are shown as horizontally hatched disks in FIG. 5 of greatly exaggerated thickness. The adhesive spots 58, 60, 62 and 64 may be at the same elevation as the vent holes 49, but located laterally outwardly thereof in that the spots 58–64 are in the pleated region of the package 10. After the pressure builds sufficiently, the adhesive spots 58, 60, 62 and 64 loosen and break.

Figure 5:
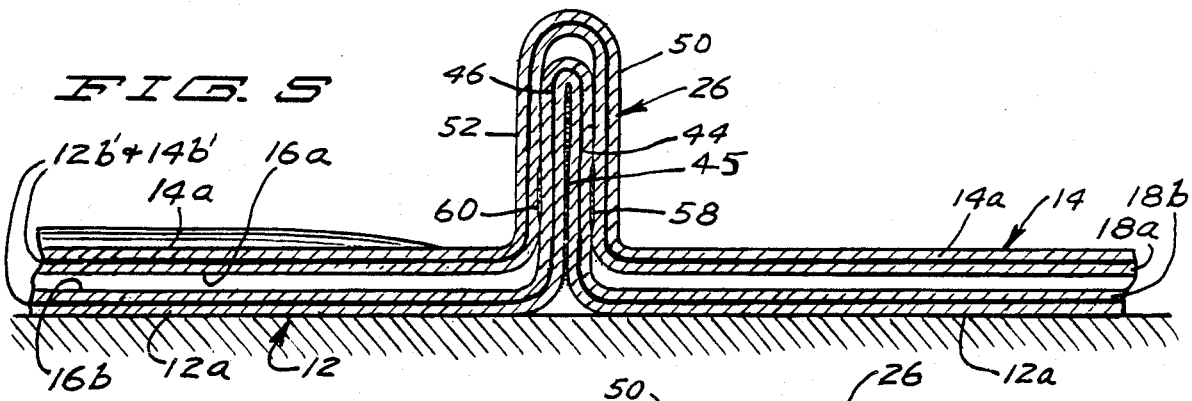
FIG. 5 is a sectional view similar to FIG. 4 but taken along the line 5—5 of FIG. 2 where there are no popcorn kernels, the view being somewhat exaggerated in order to show certain adhesive spots.
Figure 6:
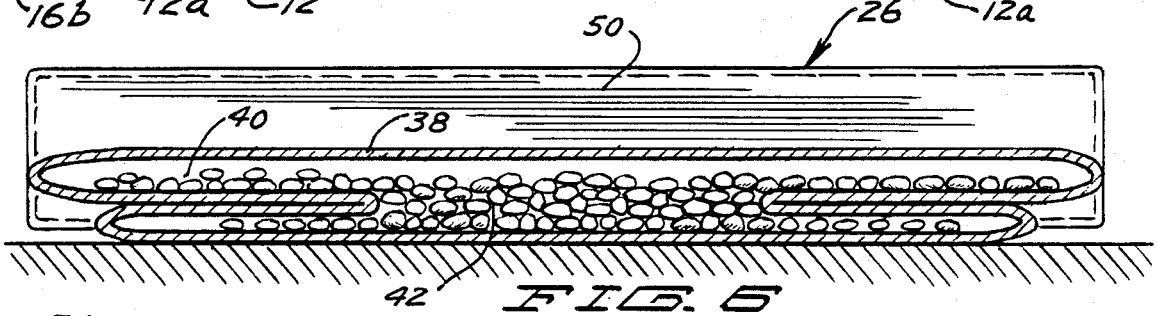
FIG. 6 is an enlarged transverse sectional view taken in the direction of line 6—6 of FIG. 2.
Figure 7:
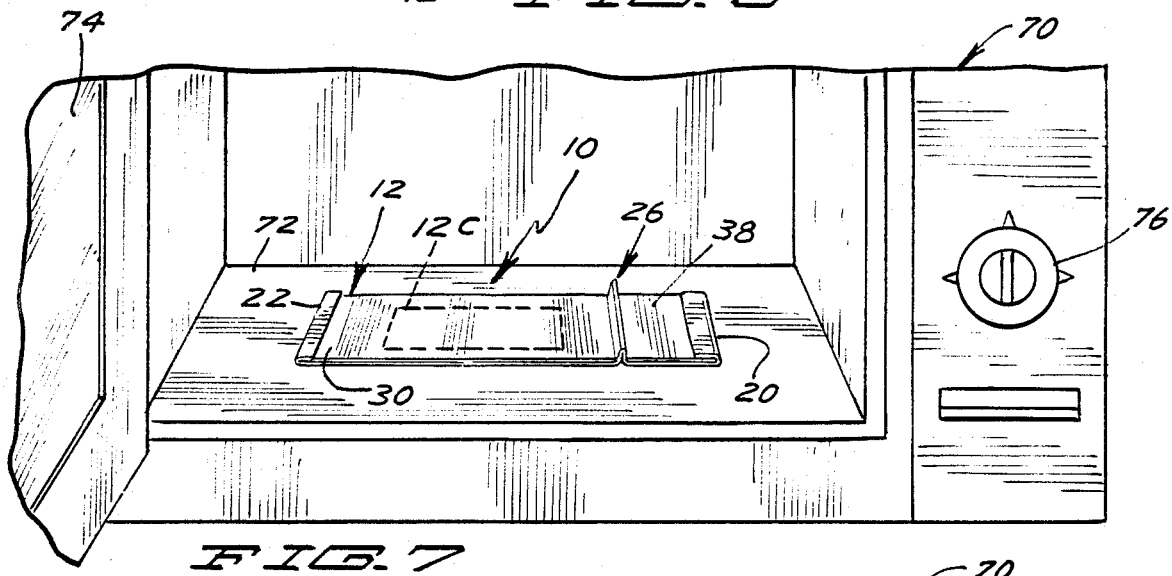

The laminated construction of the bag stock has already been mentioned. Inasmuch as the scale of FIGS. 4 and 5 is such that the layers of paper can be illustrated, attention is now directed to these two figures where it will be seen that the lower face wall 12 is comprised of a layer of kraft paper 12*a* and a layer of glassine paper 12*b*. However, a microwave coupling material in the form of a heating patch 12*c* appears at the left in FIG. 4 which may consist of a patch of metalized film or other semiconductive material that is instrumental in converting some of the microwave energy into heat energy so as to heat the compartment 32 to a considerably greater degree than the compartment 40. It should be recognized that the compartment 32 should reach a fairly high temperature in order to cause the bulk of the kernels 34 to pop, whereas the compartment 40 should be maintained at a considerably lower temperature in order to preserve the quality of the additive 42, particularly when it is composed of a cheese coating or other temperature-sensitive ingredients. With the exception of there being no patch 12*c*, the upper face wall 14 is comprised of kraft paper 14*a* and glassine paper 14*b*. Whereas it is possible in FIG. 4 to show the glassine paper 12*b* and 14*b* as separate layers, it is not practical to do this in FIG. 5 because of the presence of the pleats 16*a*, 18*a* and 18*b* in this view. Therefore, the layers of glassine paper for the kraft paper layers 12*a*, 14*a*, 16*a*, 16*b*, 18*a* and 18*b* have been indicated by the interleaved heavy lines collectively labeled 12*b*'& 14*b*'. It will be appreciated, though, that with the exception of the metalized patch 12*c*, the walls 12, 14, 16 and 18 are transparent to microwave energy.

It will be appreciated that the laminated bag stock from which the package 10 is formed is conventional and has been rather extensively employed as far as the microwave heating of popcorn. It will be understood that the bag stock is of tubular configuration to begin with and one of the features of the present invention is that the bag stock is of the same material throughout the construction of the package 10 with the exception of the metalized patch 12*c* which is simply sandwiched in between the appropriate portions of the kraft paper 12*a* and glassine liner 12*b*, more specifically, the panel 28 forming the bottom of the compartment 32 in which the kernels 34 are contained. The heating patch 12*c* is intended to underlie a sizable number of kernels 34; this can perhaps be best understood from the concealed patch 12*c* appearing in dotted outline in FIG. 2.

Owing to the vapor pressure that builds up during the popping of the kernels 34, the build-up of pressure must be controlled. While it is possible in some cases to rely on the unadhered section 24 to allow escape of some of the vapor, it is planned that the vent holes 49 be provided in the strip section 46. These vent holes 49 must be dimensionally small, actually of pinhole size, in order to prevent escape of the additive 42 (depending of course, on its viscosity) when being dispersed over the corn 34 after it has been popped. It is important to appreciate, and this is evident in FIG. 11, that the fold 26 for all intents and purposes retains its inverted U-shaped configuration, the fold 26 thereby continuing to serve as an effective dam or barrier to keep the additive 42 from prematurely "flowing" into the much hotter, and now expanded, compartment 32 where the high temperature could adversely affect the quality of the additive.

Figure 8:
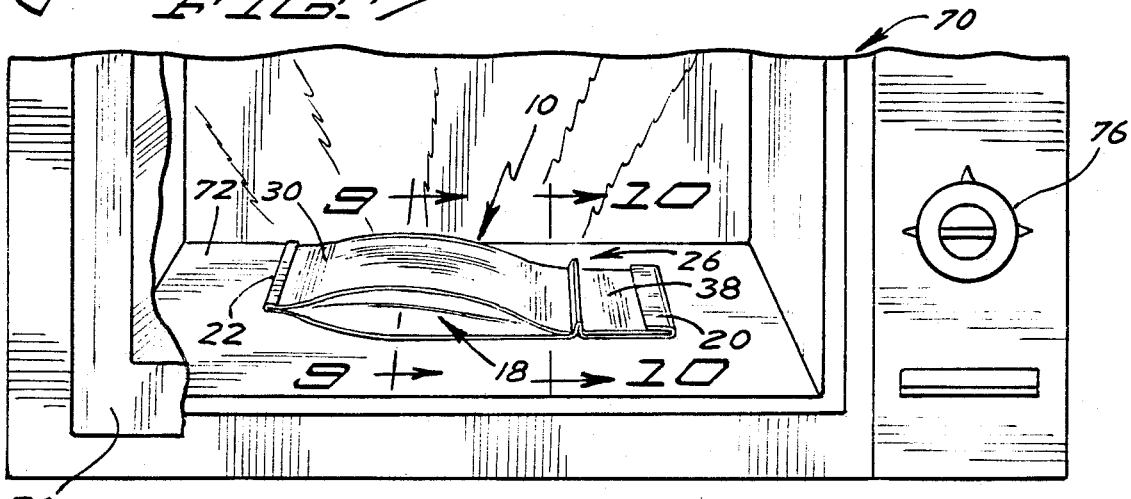
FIG. 8 is a view similar to FIG. 7 but with the fragmentarily depicted door of FIG. 7 shown in a closed position, most of the door having been removed so as to expose to view our package during an early portion of the popping cycle.
Figures 23, 24, 25:
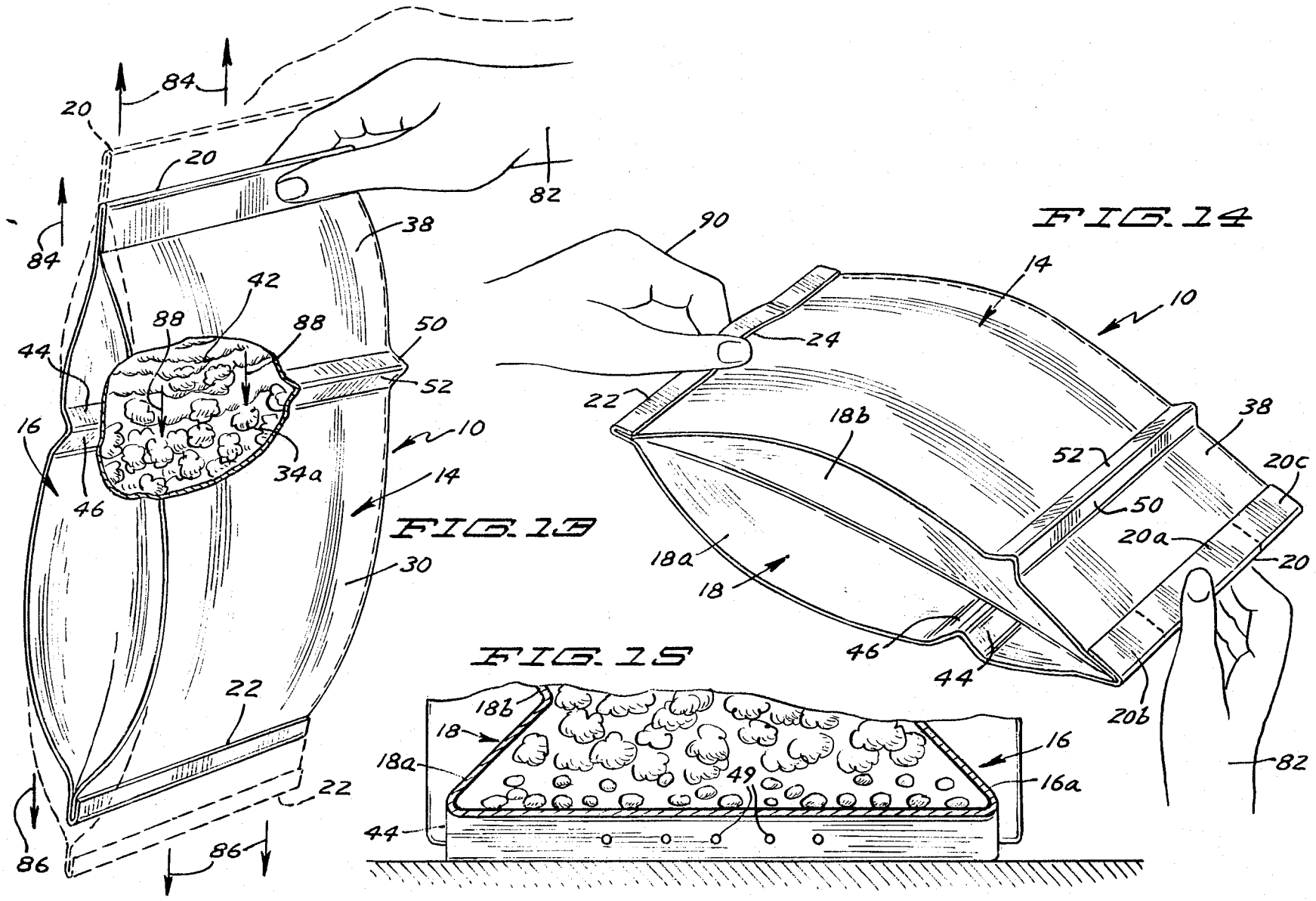

Although conventional, attention is now directed to a microwave oven 70 appearing in FIGS. 7 and 8 having a floor or bottom 72, a hinged door 74 and appropriate controls at 76. The door 74, while only fragmentarily shown, is open in FIG. 7 inasmuch as FIG. 7 represents the package 10 prior to being subjected to microwave energy. FIG. 8 depicts the package 10 in the process of being heated with microwave energy, so the door 74, even though only partially illustrated, is closed. The door 74 must be closed during the heating cycle in order to prevent the radiation of microwave energy into the surrounding air; microwave energy, as is well known, can be highly injurious to both human beings and animals.

Although not illustrated, an elevating or heating pad when placed directly under the compartment 32 can be helpful. Not only does it enhance the popping action but it raises the compartment 32 somewhat in relation to the compartment 40 thereby utilizing gravity to keep the additive 42 farther from the popping or heating pad. It will be recognized that the heating pad, when employed, is separate and distinct from the heating patch 12*c*. The heating patch 12*c* is incorporated into the package 10, and it has been previously stated that it is located between the laminations 12*a* and 12*b*.

It can be pointed out that the temperature of the compartment 32 should be relatively high, in practice on the order of from about 420° F. to 480° F., whereas the compartment 40, depending on its contents, should be maintained relatively cool, on the order of from 270° F. to 300° F. for cheese-containing additives. It would only complicate FIGS. 4 and 5 to show a thermal barrier in these figures. However, an insulating strip can be sandwiched between the strip sections 44 and 46, being adhered to the adjacent sides of the sections 44 and 46, but not so securely as to prevent the separation of these sections 44, 46, in order to vent the package 10; when used, such a supplementing barrier should have holes therein that are in alignment with the holes 49 so that when the barrier remains adhered to the strip section 46 rather than the section 44 venting can still occur. The barrier can reduce the 270°–300° F. down to 100°–150° F. or so. It will be appreciated that the compartment 32, which contains the kernels 34, should be at an elevated temperature in order to successfully pop as many of the kernels 34 as possible. On the other hand, whereas the additive 42 should be at least converted into a semi-liquid in order to permit its dispersal over the popped corn, the temperature should be kept much lower, particularly low enough to preclude scorching of the additive 42 which is especially important where a cheese compound is either contained in the additive along with a flavoring oil or constitutes the entire additive.

Having presented the frregoing description, it is believed that the benefits to be derived from a practicing of our invention can be fully appreciated. However, it can be pointed out briefly that the microwave energy supplied by the oven 70 causes the kernels 34 to pop by reason of the moisture contained in these kernels. Thus, the package 10 has a comparatively flat appearance when first placed in the microwave oven 70, as can be appreciated from FIG. 7. However, as the kernels 34 begin to pop and expand, they in turn exert a pressural action against the panels 28 and 30, causing the volume of the compartment 32 to increase, the pleated side walls 16 and 18 permitting the expansion to occur. Only a brief comparison of FIGS. 9 and 12 is necessary to see how the expansion progresses during the popping cycle.

Inasmuch as the compartments 32 and 40 are to be kept in a separate or segregated relationship with each other from the time the package 10 is filled at the factory, while on the shelf waiting to be sold and even during the first portion of the popping cycle, it is important to maintain the faithfulness of the fold 26.

However, it is desirable to have the fold 26 release at the appropriate time so as to allow some of the popped kernels, which have been given the reference numeral 34*a*, to move from the compartment 32 into the compartment 40, a condition portrayed in FIG. 11. This is a desirable feature, for initially the compartment 32 is sufficiently small so as to concentrate the heat derived from the microwave energy into a relatively small volume. This can be understood by simply looking at FIG. 3 where the panels 28 and 30 are quite close together, being separated only by the charge of kernels 34. On the other hand, as the kernels 34 become larger and larger, the pleats or gussets 16*a*, 16*b*, 18*a* and 18*b* allow the compartment 32 to become progressively larger. Ultimately, the popped kernels 34*a* fill the entire expanded compartment and further expansion exerts a pressural action on the fold 26.

A sufficient build-up of pressure will cause the fold 26 to separate so that the strip sections 50 and 52 assume a divergent relation with each other, being permitted to do so by reason of the separation of the adhesive spots 58, 60, 62 and 64. In other words they are free to move outwardly away from the strip sections 44 and 46. This separated condition is readily understood from FIG. 11.

While the popped corn 34*a* is intended to flow into the compartment 40 after communication has been established therebetween by virtue of the pressure developed in the compartment 32, it is not desirable to have the flavor additive 42 at this time pass into the compartment 32, for the additive 42 would burn if exposed to the high heat developed by the heater patch 12*c*. From FIG. 11 it can be seen that the strip sections 44 and 46 form a dam or barrier, retaining the additive 42, even though now a liquified pool, in the compartment 40. As soon as the strip sections 44 and 46 start to spread apart, due to the release of the adhesive 45 shown in FIG. 5, the vent holes 49 open to lower the vapor pressure with the package 10 sufficiently so that the sections 44 and 46 remain sufficiently folded so that they still function as a dam or barrier. The dispersal of the additive 42 is achieved by shaking the package 10 in a manner now to be referred to.

Assuming that the popping cycle has been completed, and that communication has been established between the two compartments 32 and 40, the user merely picks up the folded end 20 that is adjacent to the compartment 40. FIG. 13 shows the right hand 82 of a user holding the package 10 vertical. The shaking thereof is indicated by the upwardly pointing arrows 84 and the downwardly pointing arrows 86. Also, the phantom line position of the closed end 20 in relation with the phantom line position of the closed end 22 additionally signifies the degree of up and down shaking that causes the additive 42 to flow downwardly in the direction of the arrows 88, a portion of the package 10 having been broken away in FIG. 13 to show the movement of the additive 42.

In FIG. 14, the package 10 is shown after the shaking step of FIG. 13 has been completed. The package 10 is now ready to be opened and in addition to the person's right hand 82 the person's left hand 90 is also illustrated in FIG. 14. The user may, if he or she chooses, apply a "pulling apart" force on the package 10 with the consequence that the dam formed by the strip sections 44 and 46 virtually disappears, resulting in the more divergent relation of the strip sections 44 and 46, as appears in FIG. 14. This is where the unadhered section 24 and/or the portions or tabs 20*b* and 20*c* are beneficial, for the person can insert his or her thumb into the unadhered section 24 and/or under either of the unadhered portions 20*b* or 20*c*, then being better able to open either folded end 20 or 22 so as to gain access to the popped contents 34*a* within the package 10.

As earlier explained, the thickness of the adhesive spots 58 and 60 have been greatly exaggerated in FIG. 5. Actually, the adhesive is simply a thin coating that is applied in the areas denoted by the reference numerals 58–64 and has no physical thickness. The same thing holds true for the releasable securing of the adjacent faces of the strip sections 44 and 46 together by reason of the adhesive 45 also depicted in FIG. 5. The releasable securing of the other faces of the strip sections 44, 46 to the strip sections 50 and 52 by reason of undepicted adhesive extending over a substantial area, or even the entire surfaces of the sections 44, 50 and 46, 52. It is when the various strip sections 44, 46, 50 and 58, especially the sections 44 and 46, have separated that the vent holes 49 become open to reduce the pressure within the package 10. A suitable adhesive or sealant that has been found satisfactory in actual practice is heat sensitive polyvinyl acetate (PVAC) which is currently marketed as Franklin Chemical Duracet 12.

We claim:

1. A package for use in a microwave oven comprising a tubular bag of flexible sheet material including first and second face walls, said tubular bag being closed at its ends, a transverse fold intermediate said ends releasably retaining said first and second face walls together in an inverted U-shaped configuration to form a partition which separates the bag into first and second compartments, said fold preventing communication between said compartments, at least a portion of said first compartment being transparent to microwave energy, a microwave absorber/heat generator element in the package associated with at least said first compartment, a first food product contained in said first compartment to be heated to a high temperature, and a different food product contained in said second compartment to be heated to a lower temperature and then to be added to said first product, said second product being flowable when heated, said transverse fold forming said partition releasing said first and second face walls causing the fold to separate so that the upper face wall comes away from the lower face wall during microwave cooking due to the internal pressure created within the bag during said cooking, when the package is laid out horizontally so that said first product can expand into said second compartment yet the lower face wall maintaining its folded shape sufficient to function as a dam to prevent the flow of said second product in the second compartment into said first compartment during heating and when the bag is maintained horizontal but allowing for flow of said second product into said first compartment when the package is oriented vertically and the gap between the face walls is expanded.

2. A package in accordance with claim 1 in which a portion of said first face wall is folded inwardly and a portion of said second face wall is folded outwardly to provide said partition, the folded portion of said first face wall being nested in the folded portion of said second face wall.

3. A package in accordance with claim 2 in which sections of said folded portions are adhesively secured together.

4. A package in accordance with claim 3 including a pleat at each side of said first face wall and a pleat at each side of said second face wall and adhesive spots releasably securing the pleats of said second face wall to the folded portion of said first face wall.

5. A package in accordance with claim 2 in which the folded portion of said second face wall is separated from the folded portion of said first face wall to provide said gap and communication between said first and second compartments to allow said flow of said second product into said first compartment when the package is oriented vertically.

6. A package in accordance with claim 5 in which the first face wall is folded to provide first and second transverse strip sections in said folded region and the second face wall is folded to provide third and fourth transverse strip sections in said region, the strip sections of the folded portion of said first face wall remaining in a confronting relation to provide said dam after the strip sections of the folded portion of said second face wall have separated from the strip sections of the folded portion of said first face wall due to the internal pressure created during cooking.

7. A package in accordance with claim 6 in which the strip section of the folded portion of said first face wall are adhesively secured to each other to provide said dam.

8. A package in accordance with claim 7 in which the strip section of the folded portion of said second face wall are adhesively secured to the strip sections of the folded portion of said first face wall.

9. A package in accordance with claim 1 in which said microwave absorber/heat generator element is associated with said first compartment for heating said first product in said first compartment to said high temperature.

10. A package in accordance with claim 9 in which said first compartment is larger than said second compartment.

11. A package in accordance with claim 10 in which said microwave absorber/heat generator element is distributed throughout a major portion of one of said face walls forming said first compartment.

12. A package in accordance with claim 11 in which said microwave absorber/heat generator element comprises a metalized film.

13. A package in accordance with claim 1 in which the first food product in said first compartment includes kernels of corn to be popped and the second food product in said second compartment includes a coating for said corn.

14. A package in accordance with claim 13 in which said coating includes a cheese composition, said cheese composition constituting said additive and requiring said lower temperature which is lower than that of said first product constituting said popcorn kernels.

15. A package containing first and second food products intended to be heated to different temperatures in a microwave oven comprising a microwave absorber/-heat generator element in the package, a pair of face walls and a pair of pleated side walls, said face walls being at least partially sealed together at their ends, and said face walls being at least partially releasably folded together in a region intermediate their ends to form first and second compartments having a partition comprising said folded region therebetween which opens during microwave cooking when the package is laying horizontally so that said first food product can expand into said second compartment, a charge of kernels of corn to be popped in a microwave oven contained solely in said first compartment, said corn constituting said first food product which is to be heated to a high temperature, and an additive contained solely in said second compartment, said additive constituting said second food product which is to be heated to a lower temperature, said partition being such that the popping of said kernels at said high temperature expands said first compartment sufficiently to cause separation of said face walls in the region where they have been folded to thereby provide communication between said compartments so that said first product can expand into said second compartment, while maintaining the fold in the lower most face wall forming a transverse dam to prevent the flow of said second product in said second compartment into the first compartment during heating when the package is horizontal but allowing flow of said second product into said first compartment when the package is oriented vertically and the gap between the face walls is expanded, the partition being structured to be overcome by the internal pressure created during cooking and the initial opening of said partition being due to the internal pressure created during dooking overcoming the partition.

16. A package in accordance with claim 15 in which one of said face walls is folded inwardly to provide first and second transverse strip sections in said folded region and the other of said face walls is folded outwardly to provide third and fourth transverse strip sections in said region, said third strip section initially confronting said first strip section and said fourth strip section initially confronting said second strip section.

17. A package in accordance with claim 16 in which a portion of said thired strip section is releasably adhered to said first strip section to form said dam to prevent the flow of said second product in said second compartment into said first compartment during heating when the package is horizontal.

18. A package in accordance with claim 17 in which a portion of said fourth strip section is releasably adhered to said second strip section, the release of said third and fourth strip sections forming said dam.

19. A package in accordance with claim 18 in which the ends of said face walls are reversely folded at one end and are adhesively secured together throughout only a central portion, thereby leaving unadhered outer tabs, and in which the other ends of said face walls are adhesively secured together at only outer portions, thereby leaving an unadhered central portion.

20. A package in accordance with claim 17 in which the expansion of said first compartment causes said first and second strip sections to separate from said third and fourth strip sections, said third and fourth strip sections functioning as said dam after said first and second strip sections have separated therefrom.

21. A package in accordance with claim 21 in which said third and fourth strip sections are initially reversely folded against each other and said first and second strip sections are initially reversely folded against said third and fourth strip sections, the expansion of said first compartment during heating when the package is horizontal causing said first and second strip sections to separate from said third and fourth strip sections and to progressively assume a greater and greater degree of divergence as said expansion increases.

22. A package in accordance with claim 15 in which portions of said pleated side walls are adhered to each other adjacent said folded region.

* * * * *

UNITED STATES PATENT AND TRADEMARK OFFICE

CERTIFICATE OF CORRECTION

PATENT NO. : 4,851,246

DATED : July 25, 1989

INVENTOR(S) : Holly A. Maxwell & Robert L. Esse

It is certified that error appears in the above-identified patent and that said Letters Patent is hereby corrected as shown below:

Title Page, Attorney; "McRoy" should be -- MeRoy --.

Col. 1, line 27; "popcor" should be -- popcorn --;

line 30; "in Darrell C. Burdette U.S. Pat. No. 4,596,713, issued on June 24, 1986" should be -- in U.S. Pat. No. 4,596,713, issued on June 24, 1986 to Darrell C. Burdette --;

line 58; "directed to Charles N. Standing U.S. Pat. No. 4,132,811, granted on Jan. 2, 1979, et al." should be -- directed to U.S. Pat. No. 4,132,811, granted on Jan. 2, 1979, Charles N. Standing et al. --.

Col. 3, line 26; "provide dual" should be -- provide a dual --;

line 37; "sam" should be -- same---.

Col. 6, line 28, "2" should be -- 26 --.

Col. 8, line 56; "frregoing" should be -- foregoing --.

Col. 11, line 31; "section" should be -- sections --;

line 35; "section" should be -- sections --.

UNITED STATES PATENT AND TRADEMARK OFFICE

CERTIFICATE OF CORRECTION

PATENT NO. : 4,851,246

DATED : July 25, 1989

INVENTOR(S) : Holly A. Maxwell, et al

It is certified that error appears in the above-identified patent and that said Letters Patent is hereby corrected as shown below:

Col. 12, line 41; "thired" should be --third--;
line 63; "claim 21" should be --claim 20--.

Signed and Sealed this

Fifth Day of June, 1990

*Attest:*

HARRY F. MANBECK, JR.

*Attesting Officer*

*Commissioner of Patents and Trademarks*